United States Patent [19]

Mossinsohn

[11] 3,939,528

[45] Feb. 24, 1976

[54] VEHICLE FOR CLEANING PAVEMENTS

[76] Inventor: Igal Mossinsohn, 24, Spinoza St., Tel-Aviv, Israel

[22] Filed: May 13, 1974

[21] Appl. No.: 469,152

Related U.S. Application Data

[63] Continuation-in-part of Ser. No. 271,927, July 14, 1972, abandoned.

[30] Foreign Application Priority Data

July 21, 1971 Israel ..... 37363

[52] U.S. Cl. ..... 15/340; 15/354

[51] Int. Cl.[2] ..... A47L 9/00

[58] Field of Search ..... 15/340, 354

[56] References Cited

UNITED STATES PATENTS

| | | | |
|---|---|---|---|
| 1,015,637 | 1/1912 | Roby | 15/340 |
| 2,458,258 | 1/1969 | Furr | 15/340 |
| 3,345,671 | 10/1967 | Wilson et al. | 15/340 X |
| 3,506,998 | 4/1970 | Perry | 15/340 X |

FOREIGN PATENTS OR APPLICATIONS

| | | | |
|---|---|---|---|
| 502,056 | 11/1954 | Italy | 15/340 |
| 632,390 | 1/1962 | Italy | 15/353 |

*Primary Examiner*—Harvey C. Hornsby
*Assistant Examiner*—Christopher K. Moore
*Attorney, Agent, or Firm*—Silverman & Cass, Ltd.

[57] ABSTRACT

A vehicle for cleaning pavements or narrow places comprising a motorcycle, tri-cycle or four-wheel narrow vehicle having at least on one side at the front or rear thereof an elongated funnel through which dirt is drawn by means of a vacuum pump into a container on the vehicle. The funnel is retractable when the vehicle encounters an obstruction.

4 Claims, 4 Drawing Figures

VEHICLE FOR CLEANING PAVEMENTS

This is a Continuation-in-Part application to my pending application, Ser. No. 271.927 filed July 14, 1972, and now abandoned, entitled "VEHICLE FOR CLEANING PAVEMENTS."

BACKGROUND OF THE INVENTION

The present invention relates to vehicles for cleaning pavements of city streets, yards, and other narrow places where large motorized street cleaning machines do not have ready access.

DESCRIPTION OF THE PRIOR ART

Pavements of city streets are generally swept manually by non-skilled workers who either walk back and forth along the pavement pushing a broom and thus cleaning a certain length of pavement. They may also walk back and forth across the pavement between the curbstone and the wall, sweeping the pavement along its width. It will be appreciated that this manual cleaning of streets is time consuming and very expensive in labor cost.

The present invention seeks to provide a vehicle for cleaning pavements which can accomplish the work of many workers in a short time, thus saving large labor cost and time for the city.

The invention comprises a vehicle for cleaning pavements, to at least one side of which at the rear part thereof an elongated rectangular funnel is articulated, which, through a vacuum pump operated by a motor carried by the vehicle, is in communication with a dust-collecting container, likewise carried by the vehicle, means being provided to retract said funnel when it encounters an obstruction. The vehicle may be a motorcycle, a tricycle or a narrow four-wheel structure.

In a preferred embodiment of the invention, a funnel is articulated at either side of a motorcycle.

The means for extending and retracting said funnel may be manual, such as a spring-actuated push-rod operated by the driver. According to a preferred embodiment of the invention the means for retracting the said funnel comprise a hydraulic or pneumatic cylinder and piston, articulated between the side of the vehicle and the funnel.

The prior art discloses heavy cleaning machines or vehicles which may properly operate on roads, but are incapable of efficiently and quickly cleaning side-pavements for pedestrians.

The patent to Wilson, et al. U.S. Pat. No. 3.345.671 shows two forward castors 12 and two rear drive wheels 14 near the longitudinal center line of the vehicle. Thus the patent does not show a motorcycle or a tricycle as envisaged by Applicant.

The Italian patent to Tamini, No. 502,056, does not describe a three-wheel vehicle. The patent only mentions that the vehicle may be mechanical or animal drawn.

Furthermore, the prior art publications, aside from dealing with heavy vehicles, inasmuch as they allow retraction of sweeping brushes into the vehicle at all, do not contemplate swinging movements at such wide angles as envisaged by the present invention. All that the brushes can perform is a slight movement out of the vehicle during cleaning and their return to the underside of the vehicle's chassis.

In contrast thereto, the funnel of Applicant's vehicle can be deflected up to an angle of 90° and can be retracted almost completely to lie adjacent the side of the vehicle.

SUMMARY OF THE INVENTION

A vehicle for cleaning pavements comprising of at least one elongated funnel pivotably fastened to a side of the vehicle at the rear part thereof, a dust collecting container removably mounted on the rear part of the vehicle and a motor-pump, wherein the funnel can be deflected up to a right angle relative to the vehicle and retracted therefrom, enabling the vehicle to move in sharp turns and clean narrow spaces.

DESCRIPTION OF THE PREFERRED EMBODIMENTS

Figure 1:
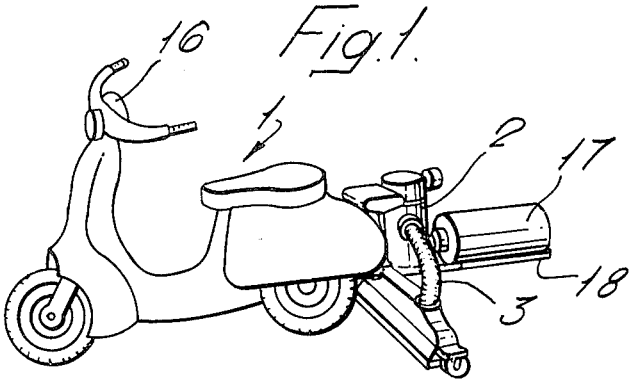
FIG. 1 is a schematic perspective view of one embodiment of the vehicle for cleaning pavements according to the invention.

In FIG. 1, the vehicle according to the invention comprises a motorcycle indicated generally at 1, which has mounted to its rear end a motor 2 which operates a vacuum pump (not shown). Said pump is by means of a flexible pipe 3 on either side of the motorcycle in communication with an elongated funnel 4, the mouth 5 of which is rectangular and faces the front of the motorcycle during the normal cleaning operation of the vehicle. The inner end of funnel 4, i.e. the end which lies adjacent motorcycle 1 is provided with an apertured lug 6 which extends outwardly and is engaged between two similarly apertured lugs 7 of a connecting number 8. A vertically extending pin 9 is inserted into the registering apertures of lugs 6 and 7 so that funnel 4 can be swung about a vertical axis. Connecting member 8 has a horizontal bore 10 through which a pin (not shown) extends, the pin being mounted in bearings (not shown) fixed to the back of the body of the motorcycle. In order to support the funnel 4 at the side remote from its mounting, a castor wheel 11 is fixed to the outside of the funnel.

Each funnel is adapted to be extended up to an angle of approximately 90° relative to the motorcycle and is adapted to be retracted completely to lie adjacent the side of the motorcycle, or to extend at any angle between these positions, the angle being determined by the degree necessary to by-pass any obstruction, e.g. lamp post, tree or the like, on the side walk. The retraction or extension is effected by means of a hydraulic cylinder 12 whose piston rod 13 is articulated at 14 to the funnel 4, the cylinder 12 being articulated by means of bracket connection 15 to the body of the motorcycle. The hydraulic cylinders may be connected into the hydraulic system of the motorcycle itself or they may have their own hydraulic supply line. The cylinders are operated by the driver by means of a control 16 near the handle bars, whenever he sees an obstruction or whenever castors 11 encounter an obstruction.

A dust-collecting container 17 in the form of a porous sack is removably mounted on the rear part of the vehicle behind the funnel and is supported by a rack 19 mounted in horizontal position to the back end of the motorcycle. The sack 17 may be attached to the pump by screws and may have a slide fastener at its side to facilitate the removal of the collected dirt. If desired, it may be hooked to a bracket or the like being mounted in vertical position. There may be one common dust collecting sack for both funnels or there may be one for each funnel.

If desired, a roller brush (not shown) may be mounted in front of each funnel mouth and supported from the sides of the funnel in such a manner that it is freely rotatable owing to the frictional contact with the pavement, sweeping and throwing the dust into the mouth of the funnel.

Figure 2:
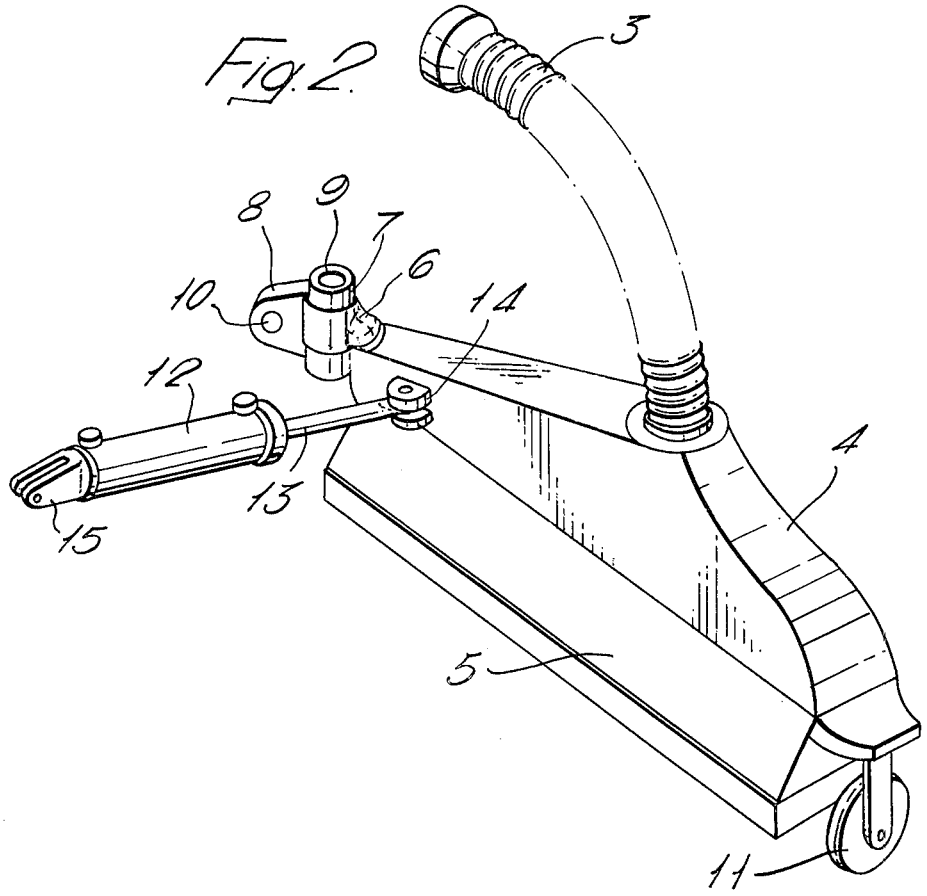
FIG. 2 is a perspective view on a larger scale of a funnel and its mounting.
Figure 3:
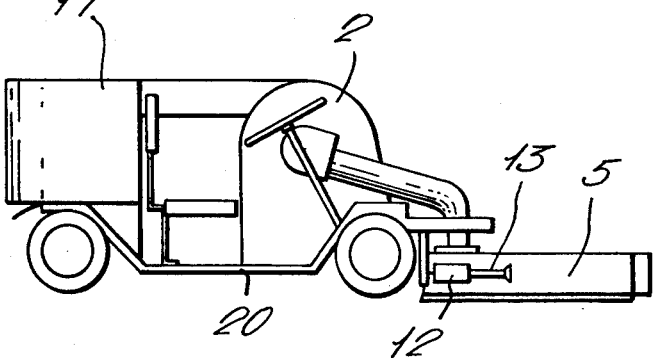
FIG. 3 is a schematic side elevation of another embodiment of a vehicle for cleaning pavements according to the invention.

In the following description, relative to FIGS. 3 and 4, parts similar to those of FIGS. 1 and 2 have been referenced with the same numerals.

Here, the vehicle for cleaning pavements comprises a tricycle or four-wheeled vehicle 2, having a seat 21 and a steering wheel 22 which for the sake of clarity have been shown in the drawings to be of small size, but, in fact, are much larger. The funnels 5 may be articulated at the front or rear at both sides of the vehicle and are retracted or extended as required by piston rod 13 of the hydraulic cylinder 12 which is pivotally attached to the vehicle. The vacuum pump and motor 2 which are mounted on the vehicle are in communication with funnel 5 by means of pipe 3, the dust collector 17 which in this case extends over the width of the entire vehicle being mounted at its rear.

Figure 4:
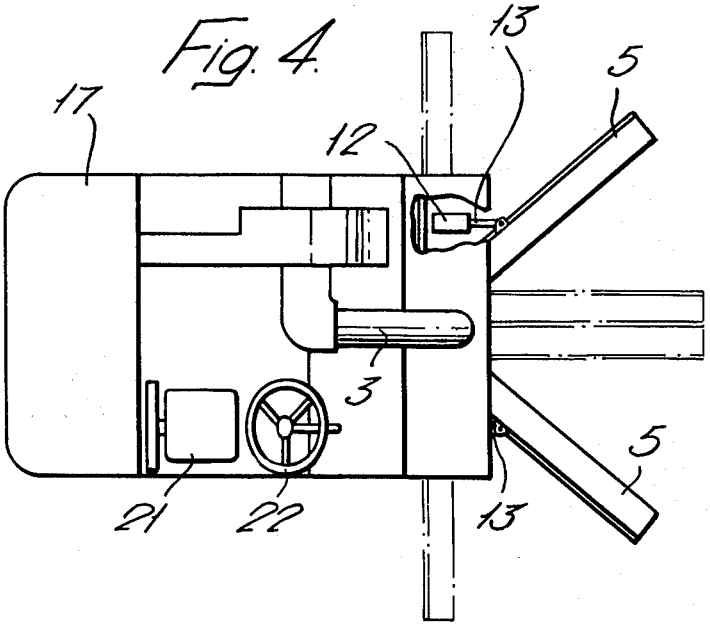
FIG. 4 is a schematic plan view thereof.

The extreme positions of the funnel 5 are shown in dash-dotted lines in FIG. 4 and it will be appreciated that even though the vehicle is of narrow width, the cleaning operation can be carried out over a much greater width.

What it is desired to secure by Letters Patent of the United States is:

1. A light, versatile vehicle for cleaning narrow passages, comprising:

a. two wheels secured to the vehicle, which comprise the sole support for the vehicle, and which are arranged in tandem fashion, the forward wheel being steerable, b. at least one elongated rectangular funnel pivotably fastened to a side of the vehicle at the rear part thereof, c. a dust collecting container carried on the vehicle and removably connected to the rear part thereof behind said at least one funnel, d. a vacuum pump and a motor for operating the same, both mounted onto the vehicle, e. means associated with the pump for providing communication between the said at least one funnel and the container, f. means for deflecting the said at least one funnel up to an angle of 90 ° relative to the longitudinal axis of the vehicle, and means for retracting the said at least one funnel upon encountering an obstruction to lie adjacent the side of the vehicle.

whereby the vehicle is capable of moving in sharp curves while cleaning sidewalks, narrow passages and insides of containers.

2. A vehicle as claimed in claim 1, wherein said at least one funnel comprises two funnels of said configuration, each funnel respectively fastened in said manner, to a side of the vehicle at the rear part thereof.

3. A vehicle as claimed in claim 1 wherein the means for retracting the said at least one funnel comprise a hydraulic cylinder and piston pivotably connected between the said side of the vehicle and the said at least one funnel.

4. A vehicle as claimed in claim 1 wherein the means for retracting the said at least one funnel comprise a pneumatic cylinder and piston pivotably connected between the said side of the vehicle and the said at least one funnel.

* * * * *